US009687038B2

(12) United States Patent
Chae

(10) Patent No.: US 9,687,038 B2
(45) Date of Patent: Jun. 27, 2017

(54) IRONING APPARATUS FOR HAT

(71) Applicant: Keum-ok Chae, Gyeonggi-do (KR)

(72) Inventor: Keum-ok Chae, Goyang-si (KR)

( * ) Notice: Subject to any disclaimer, the term of this patent is extended or adjusted under 35 U.S.C. 154(b) by 0 days.

(21) Appl. No.: 14/905,801

(22) PCT Filed: Jul. 15, 2014

(86) PCT No.: PCT/KR2014/006347

§ 371 (c)(1),
(2) Date: Jan. 16, 2016

(87) PCT Pub. No.: WO2015/009006

PCT Pub. Date: Jan. 22, 2015

(65) Prior Publication Data

US 2016/0150846 A1 Jun. 2, 2016

(30) Foreign Application Priority Data

Jul. 17, 2013 (KR) ..... 10-2013-0083939

(51) Int. Cl.

| | |
|---|---|
| ***A42C 1/00*** | (2006.01) |
| ***A42C 1/08*** | (2006.01) |
| ***D06F 71/18*** | (2006.01) |
| ***D06F 73/00*** | (2006.01) |

(52) U.S. Cl.

CPC ..... *A42C 1/08* (2013.01); *D06F 71/18* (2013.01); *D06F 73/00* (2013.01)

(58) Field of Classification Search

CPC ..... D06F 73/00; D06F 73/02; D06F 71/18; A42C 1/08

USPC ..... 223/21, 24, 26

See application file for complete search history.

(56) References Cited

U.S. PATENT DOCUMENTS

| | | | | |
|---|---|---|---|---|
| 1,492,083 A * | 4/1924 | Pegues | D06F 87/00 | 126/369 |
| 1,699,073 A * | 1/1929 | Logan | A42C 3/00 | 223/24 |
| 2,170,591 A * | 8/1939 | Holt | D06F 75/30 | 223/70 |

(Continued)

FOREIGN PATENT DOCUMENTS

| | | |
|---|---|---|
| JP | 07278938 | 10/1995 |
| KR | 20040003542 | 1/2004 |

(Continued)

*Primary Examiner* — Nathan Durham

(74) *Attorney, Agent, or Firm* — Renaissance IP Law Group LLP

(57) ABSTRACT

Disclosed is an ironing apparatus for a hat. The ironing apparatus for a hat includes: a hollow spherical conductor having an opening formed at a lower portion thereof; supports installed under the spherical conductor to support the spherical conductor with being spaced apart from a bottom plate; and a hot air supplier installed under the opening formed at the lower portion of the spherical conductor to vertically supply hot air to an inner space of the spherical conductor. According to the present invention, it is possible to rapidly and economically ironing the hat, thereby improving a commercial value of the hat. Further, according to the present invention, it is possible for a user to freely use his/her two hands while adjusting heat required for ironing by using his/her foot during ironing the hat, thereby improving ironing quality of the hat.

11 Claims, 3 Drawing Sheets

(56) References Cited

U.S. PATENT DOCUMENTS

| | | | | | |
|---|---|---|---|---|---|
| 2,281,546 | A * | 5/1942 | Berger | A42C 1/08 | 223/15 |
| 3,254,757 | A * | 6/1966 | Raskin | A47F 7/06 | 132/56 |
| 3,568,900 | A * | 3/1971 | Paris | D06F 73/00 | 223/70 |
| 4,157,151 | A * | 6/1979 | Sanko | A42C 1/04 | 223/13 |
| 4,173,300 | A * | 11/1979 | Sanko | D06F 73/00 | 223/70 |
| 6,052,928 | A * | 4/2000 | Lin | D06F 73/00 | 223/21 |
| 6,581,809 | B1 * | 6/2003 | McElhinney | A42C 3/00 | 223/51 |

FOREIGN PATENT DOCUMENTS

| | | |
|---|---|---|
| KR | 200392650 | 8/2005 |
| KR | 20110034277 | 4/2011 |

* cited by examiner

IRONING APPARATUS FOR HAT

TECHNICAL FIELD

The present invention relates to an ironing apparatus for a hat, and more specifically, to an ironing apparatus for a hat which is capable of rapidly and economically ironing a hat to thus improve a commercial value of the hat, and allows a user to freely use his/her two hands while adjusting heat required for ironing by using his/her foot during ironing the hat, thereby improving ironing quality of the hat.

BACKGROUND ART

In recent years, a market for purchase and sales of second-hand luxury clothes is rapidly increased, and among such the used luxury clothes, hats are especially a hot item and frequently traded, that is, purchased and sold.

However, the hat has easily done damage of its shape and has wrinkled during use for a long time, thus involving a problem that the hats distributed in the second-hand luxury clothes market are mostly not recognized to have marketability.

Accordingly, it is necessary to conduct maintenance work of hats as one of the second-hand clothes such as ironing before resale thereof. However, conventionally, an apparatus for rapidly and economically ironing the hat has not yet been developed.

DISCLOSURE

Technical Problem

Accordingly, it is an object of the present invention to provide an ironing apparatus for a hat which is capable of rapidly and economically ironing a hat to thus improve a commercial value of the hat, and allows a user to freely use his/her two hands while adjusting heat required for ironing by using his/her foot during ironing the hat, thereby improving ironing quality of the hat.

Technical Solution

In order to achieve the above-described object, there is provided an ironing apparatus for a hat, including: a hollow spherical conductor 110 having an opening formed at a lower portion thereof; supports installed under the spherical conductor 110 to support the spherical conductor 110 with being spaced apart from a bottom plate; and a hot air supplier 130 installed under the opening formed at the lower portion of the spherical conductor 110 to vertically supply hot air to an inner space of the spherical conductor 110.

Preferably, the ironing apparatus may further include a hot air guide tube 140 installed at the lower portion of the spherical conductor 110 to prevent the hot air vertically supplied from the hot air supplier 130 from being dispersed.

In addition, the spherical conductor 110 is heated by the hot air.

In addition, the ironing apparatus may further include a control pedal 150 placed on a floor and electrically connected to the hot air supplier 130 so as to allow a user to control an operation of the hot air supplier 130 by his/her foot while pressing the hat put on the spherical conductor 110 by two hands of the user.

In addition, the ironing apparatus may further include a sunshade support 145 configured to support a sunshade of the hat put on the spherical conductor 110.

Advantageous Effects

According to the present invention, it is possible to rapidly and economically iron the hat, thereby improving the commercial value of the same.

Further, according to the present invention, the user can freely use his/her two hands while adjusting heat required for ironing by using his/her foot, thereby improving ironing quality of the hat.

BEST MODE

Figure 1:
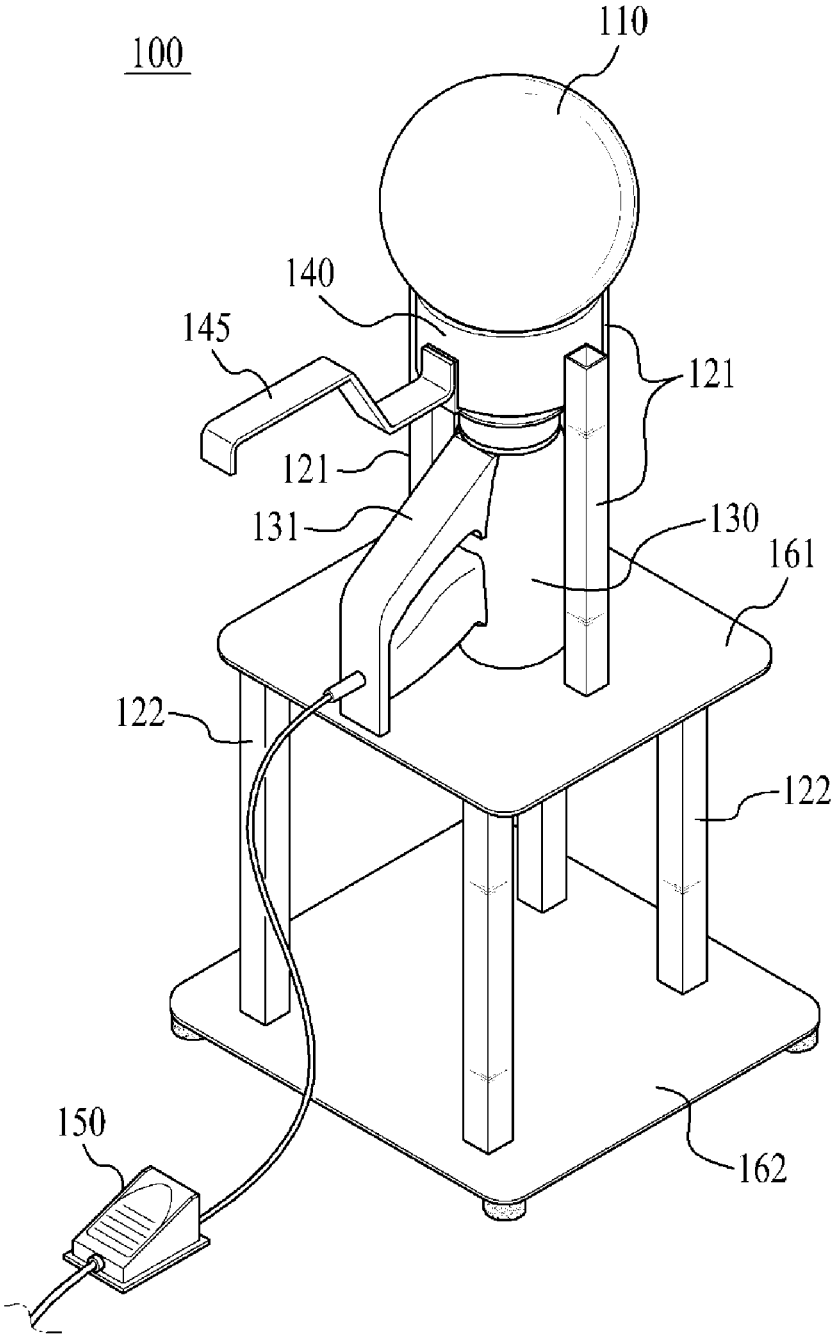
FIG. 1 is a view illustrating a structure of an ironing apparatus for a hat according to an embodiment of the present invention.

Hereinafter, preferable embodiments of the present invention will be described with reference to the accompanying drawings. Referring to the drawings, wherein like reference characters designate like or corresponding parts throughout the several views. In the embodiments of the present invention, a detailed description of publicly known functions and configurations that are judged to be able to make the purport of the present invention unnecessarily obscure will not be described.

FIG. 1 is a view illustrating a structure of an ironing apparatus for a hat according to an embodiment of the present invention. Referring to FIG. 1, the ironing apparatus for a hat 100 according to the embodiment of the present invention includes a spherical conductor 110, support plates 121 and 122, a hot air supplier 130, a hot air guide tube 140, a control pedal 150 and bottom plates 161 and 162.

Figure 3:
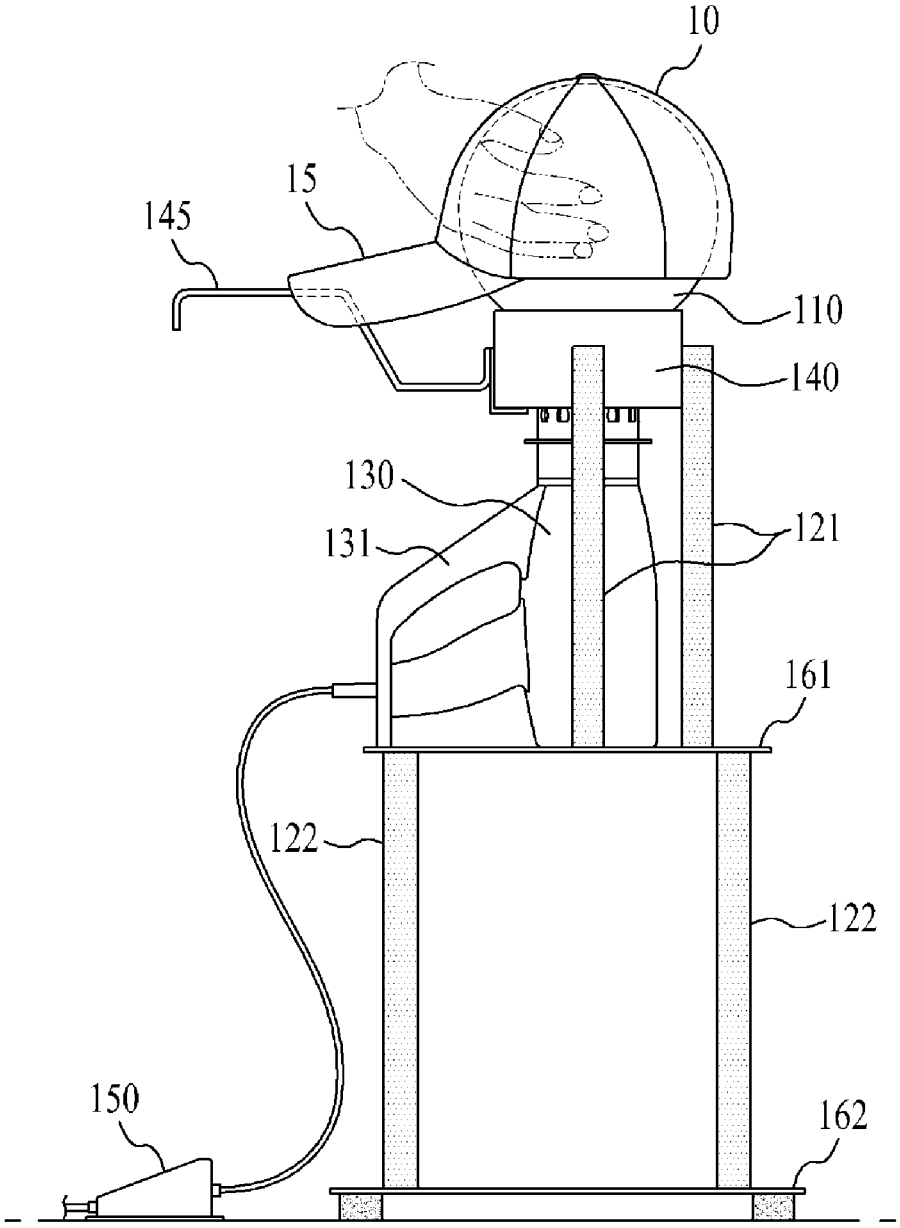
FIG. 3 is a view illustrating a statue of using the ironing apparatus for a hat illustrated in FIG. 1.

The spherical conductor 110 may be made of a metal material with high thermal conductivity such as aluminum, stainless steel, etc., and have a hollow spherical structure. Meanwhile, a user may supply hot air through the hot air supplier 130 installed under a lower portion of an opening formed at the lower portion of the spherical conductor 110 while putting the hat 10 on the spherical conductor 110, as illustrated in FIG. 3.

Figure 2:
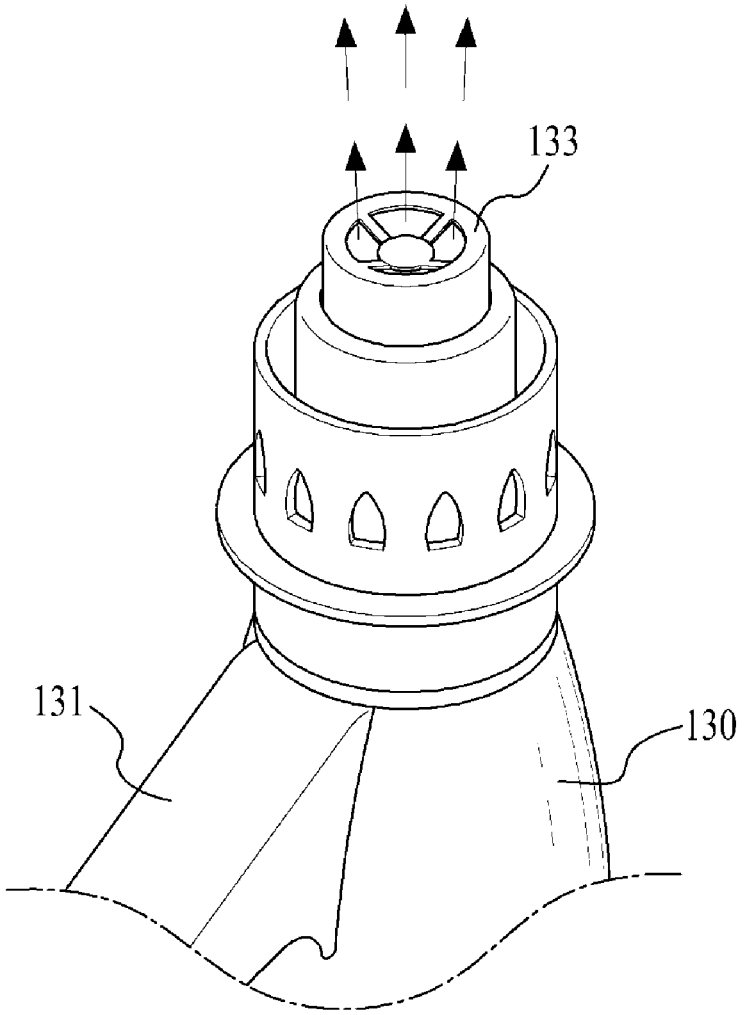
FIG. 2 is a view illustrating a structure of a hot air supplier included in the ironing apparatus for a hat illustrated in FIG. 1.

Accordingly, as illustrated in FIG. 2, the hot air emitted upward through the hot air supplier 130 may flow into the spherical conductor 110 to heat the spherical conductor 110, therefore, wrinkles of the hat closely fixed to the heated surface of the spherical conductor 110 may be unwrinkled and ironed.

Further, the hot air supplier 130 illustrated in FIG. 2 may have a handle 131 allowing the user to adjust an installed position of the hot air supplier while gripping the same or easily separate the hot air supplier from the ironing apparatus for a hat 100. The hot air supplier may also emit hot air through a hot air outlet 133 while having an electrical heat coil therein to be heated by a power supplied from an outside.

Further, the ironing apparatus for a hat 100 according to the present invention may include an upper support 121 installed under the lower portion of the spherical conductor 110 to support the spherical conductor 110 with being spaced apart from a first bottom plate 161. In particular, the first bottom plate 161 on which a plurality of the upper supports 121 are installed is further supported by a lower support 122 with being spaced apart from a second bottom plate 162 which is disposed on a floor in contact therewith.

Meanwhile, since the hot air supplier 130 is installed on the first bottom plate 161 spaced apart from the second bottom plate 162 at a predetermined height, the user may conveniently conduct operations such as an adjustment of the installed position of the hot air supplier 130 while sitting down on a chair (not illustrated) connected and installed on the ironing apparatus for a hat 100.

Moreover, in order to prevent the hot air vertically supplied from the hot air supplier 130 installed under the lower portion of the spherical conductor 110 from being dispersed to an ambient instead of flowing into the opening formed at the lower portion of the spherical conductor 110, as illustrated in FIG. 1, it is preferable that a cylindrical hot air guide tube 140 is fixed by welding around the opening of the spherical conductor 110, and a plurality of the upper supports 121 are also fixed by welding around the hot air guide tube 140.

Meanwhile, the hot air guide tube 140 may mainly serve to prevent the hot air vertically supplied from the hot air supplier 130 from being dispersed to an outside, while not functioning to iron the hat 10. Therefore, in order to prevent heat of the hot air from being unnecessarily transferred to the hot air guide tube 140, it is preferable that the hot air guide tube 140 is made of a metal material with a low thermal conductivity or a heat-insulating material.

Further, it is preferable that a sunshade support 145 configured to support the sunshade 15 of the hat 10 put on the spherical conductor 110, as illustrated in FIG. 1, is fixed to an outer circumference surface of the hot air guide tube 140.

That is, by providing the sunshade support 145, as illustrated in FIG. 3, the sunshade 15 of the hat 10 put on the spherical conductor 110 may be horizontally supported, and a central portion of the sunshade 15 of the hat 10, which is the most concave part, may be supported by the sunshade support 145. As a result, the hat may be put on the spherical conductor 110 at a correct angle with being put on the spherical conductor 110, without being inclined in any of front, rear, right and left directions.

As illustrated in FIG. 3, since the hat 10 is ironed with being put on the spherical conductor 110 at a correct angle, the hat may be ironed so as to have substantially the same shape as the user correctly wears the hat 10.

Further, in order to prevent the hat 10 from being tilted right or left while the central portion of the sunshade 15 of the hat 10 is supported by the sunshade support 145, it is preferable that the sunshade support 145 is configured to support the sunshade 15 of the hat 10 by a supporting face having a constant width, as illustrated in FIG. 1.

Meanwhile, in order to prevent the hand of the user from getting burned by the sunshade support 145, it is preferable that the sunshade support 145 is made of a metal material with low thermal conductivity or a heat-insulating material.

In addition, in order to avoid an obstruction of the hat 10 by the sunshade support 145 during being put on the spherical conductor 110, it is preferable that the sunshade support 145 is attached to the hot air guide tube 140 installed under the lower portion of the spherical conductor 110. Further, in order to avoid an obstruction of the sunshade support 145 in putting the hat 10 on the spherical conductor 110 at a portion adjacent to the hot air guide tube 140, it is more preferable that the sunshade support 145 is formed by fixing the same on the hot air guide tube 140 while bending the sunshade support 145 in an 'L' shape ('a first bent part') at a portion adjacent to the hot air guide tube 140; bending the sunshade support 140 upward ('a second bent part') at a position apart from the hot air guide tube 140 at a constant interval (about 5 to 10 cm); further bending the same in a horizontal direction ('a third bent part') at a position apart from the second bent part at a constant interval (about 3 to 5 cm), as illustrated in FIG. 1.

Further, the hot air supplier 130 is driven by a power supplied thereto from an external power supply through a wire, and an operation including stopping or increasing the hot air of the hot air supplier 130 is controlled by the control pedal 150 placed on the floor and electrically connected to the external power supply through the wire for supplying the power to the hot air supplier 130, as illustrated in FIG. 1.

More particularly, when the user presses down the control pedal 150 in a state of placing his/her foot on the control pedal 150, the hot air supplier 130 may be driven to emit hot air upward. When the user takes off his/her foot from the control pedal 150, the operation of the hot air supplier 130 may be stopped.

Further, when the user gradually adds a force to his/her foot while placing the foot on the control pedal 150 to increase a degree of pressing the control pedal 150, a driving output of the hot air supplier 130 may be gradually increased, and therefore, the user may control the driving output of the hot air supplier through the control pedal 150 on the basis of working environments such as ironed condition of the hat 10, fabric or materials of the hat 10, or the like.

As described above, according to the present invention, it is possible to achieve the hot air supplier 130 whose operation is controlled by the control pedal 150, two hands of the user may become free. Therefore, as illustrated in FIG. 3, the user can freely adjust a portion of the hat to be pressed with his/her two hands while applying a pressure to the hat 10 and closely contact it to the spherical conductor 110 by using two hands, and may control the operation of the hot air supplier and the driving output thereof while achieving excellent ironing quality.

While the present invention has been described with reference to the preferred embodiments and modified examples, the present invention is not limited to the above-described specific embodiments and the modified examples, and it will be understood by those skilled in the related art that various modifications and variations may be made therein without departing from the scope of the present invention as defined by the appended claims, as well as these modifications and variations should not be understood separately from the technical spirit and prospect of the present invention.

The present invention is applicable in the laundry-related industrial field.

The invention claimed is:

1. An ironing apparatus for a hat, comprising:

a hollow spherical conductor having an opening formed at a lower portion thereof;

a bottom plate arranged vertically under the spherical conductor;

supports installed between the spherical conductor and the bottom plate, to support the spherical conductor relative to the bottom plate;

a hot air supplier installed on the bottom plate and under the opening formed at the lower portion of the spherical conductor to vertically supply hot air to an inner space of the spherical conductor; and a sunshade support configured to support a sunshade of the hat put on the spherical conductor; and a hot air guide tube configured to prevent the hot air supplied vertically from the hot air supplier from dispersing into an ambient environment outside the spherical conductor, wherein the sunshade support is coupled to the hot air guide tube such that the sunshade of the hat put on the spherical conductor is horizontally supported, wherein the sunshade support includes:

a first portion relatively close to the hot air guide tube; and a second portion relatively far from the hot air guide tube, wherein the second portion of the sunshade support is vertically closer to the spherical conductor than the first portion of the sunshade support.

2. The ironing apparatus according to claim 1, wherein the spherical conductor is heated by the hot air.

3. The ironing apparatus according to claim 1, further comprising a control pedal placed on a floor and electrically connected to the hot air supplier so as to allow a user to control an operation of the hot air supplier by his/her foot while pressing the hat put on the spherical conductor by two hands of the user.

4. The ironing apparatus according to claim 1, wherein the sunshade support includes a supporting face having a constant width, and wherein the sunshade support is configured such that the sunshade of the hat put on the spherical conductor is supportable by the supporting face.

5. The ironing apparatus according to claim 1, wherein the spherical conductor is formed of a material having a higher thermal conductivity than a material from which the sunshade support is formed.

6. The ironing apparatus according to claim 1, further comprising a hot air guide tube coupled to the spherical conductor at the opening formed at the lower portion of the spherical conductor, wherein the hot air guide tube is configured to prevent the hot air supplied vertically from the hot air supplier from dispersing into an ambient environment outside the spherical conductor.

7. The ironing apparatus according to claim 6, wherein the spherical conductor is formed of a material having a higher thermal conductivity than a material from which the hot air guide tube is formed.

8. The ironing apparatus according to claim 6, wherein the hot air guide tube is arranged between the supports.

9. The ironing apparatus according to claim 1, wherein the hot air supplier is movable relative to the spherical conductor.

10. An ironing apparatus for a hat, comprising:

a hollow spherical conductor having an opening formed at a lower portion thereof;

a bottom plate arranged vertically under the spherical conductor;

supports installed between the spherical conductor and the bottom plate, to support the spherical conductor relative to the bottom plate;

a hot air supplier installed on the bottom plate and under the opening formed at the lower portion of the spherical conductor to vertically supply hot air to an inner space of the spherical conductor; and a hot air guide tube coupled to the spherical conductor at the opening formed at the lower portion of the spherical conductor, wherein the hot air guide tube is configured to prevent the hot air supplied vertically from the hot air supplier from dispersing into an ambient environment outside the spherical conductor, wherein the spherical conductor is welded to the hot air guide tube.

11. An ironing apparatus for a hat, comprising:

a hollow spherical conductor having an opening formed at a lower portion thereof;

a bottom plate arranged vertically under the spherical conductor;

supports installed between the spherical conductor and the bottom plate, to support the spherical conductor relative to the bottom plate;

a hot air supplier installed on the bottom plate and under the opening formed at the lower portion of the spherical conductor to vertically supply hot air to an inner space of the spherical conductor, wherein the opening in the lower portion of the spherical conductor is the only opening in the spherical conductor.

* * * * *